United States Patent [19]

Six

[11] Patent Number: 4,628,816

[45] Date of Patent: Dec. 16, 1986

[54] PRINTING APPARATUS

[76] Inventor: Albert J. Six, 22425 Santa Paula Ave., Cupertino, Calif. 95014

[21] Appl. No.: 622,693

[22] Filed: Jun. 20, 1984

[51] Int. Cl.[4] ..... B41F 5/06; B41F 5/16; B41L 49/02

[52] U.S. Cl. ..... 101/426; 101/181; 101/76

[58] Field of Search ..... 101/172, 76, 181, 77, 101/177, 426, 183, 184, 179, 180, 228, 66, 219, 91, 84, 85, 92

[56] References Cited

U.S. PATENT DOCUMENTS 4,287,824 9/1981 Boyle ..... 101/172

*Primary Examiner*—J. Reed Fisher

*Attorney, Agent, or Firm*—Fliesler, Dubb, Meyer & Lovejoy

[57] ABSTRACT

A printing machine (10) is adapted for printing a plurality of imprints (12) onto a sheet (14) divided into a plurality of sequentially longitudinally spaced printing fields (16) having a selected field length and being divided into a plurality of longitudinally and laterally spaced printing domains (18). The machine (10) includes a plurality of spaced printing rolls (**20*a*–20*f*) having parallel axes (22*a*–22*f*) and peripheral cylindrical surfaces (24*a*–24*f*) having image transfer regions (26*a*$^1$–26*f*$^{nf}$) adapted to print the imprints (12) onto the sheet (14). The rolls (20*a*–20*f*) each have circumstances (28*a*–28*f*) which are different integral multiples of the field length and which are not integral multiples of one another. Each of the cylindrical surfaces (28*a*–28*f*) has a subset of the image transfer regions (26*a*$^1$–26*f*$^{nf}$) positioned to print the imprints (12) on only a selected subset of the printing domains (18), the selected subsets of the printing domains (18) having a null set intersection. The rolls (20*a*–20*f*) are rotated about their axis so that the cylindrical surfaces (24*a*–24*f*) have equal tangential velocities. An image reproducing medium is transferred onto each of the image transfer regions (26*a*$^1$–26*f*$^{nf}$). The sheet (14) is moved longitudinally generally tangentially sequentially adjacent each of the cylindrical surfaces (24*a*–24*f*) at a velocity to match that of the cylindrical surfaces (24*a*–24*f*). The image reproducing medium is transferred from the image transfer regions (26*a*$^1$–26*f*$^{nf}$) to the printing domains (18**).

12 Claims, 3 Drawing Figures

30
26e1 . . . 26ene
24e
34e
34d
24
26d1 . . . 26dnd
22e
20e
20d
26d
26f1 . . . 26fnf
40e
28e
28d
40d
22d
12
40f
28f
40g
40h
26f
24f
22f
20f
20g
20h
28g
28h
34g
34h
14
34f
36
38

PRINTING APPARATUS

BACKGROUND OF THE INVENTION

1. Technical Field

The invention relates generally to a printing apparatus and more particularly relates to a printing apparatus which is useful for preparing a very large but finite number of non-identical printed patterns of printed material before repetition of any particular pattern.

2. Background Art

In certain instances it is desirable to be able to reproduce many different patterns by printing before any one pattern is repeated. For example, in many states it is legal to play such games as bingo for the purpose of gambling. Generally, the prospective player purchases one or more bingo sheets, each of which will usually contain several bingo faces (five by five arrays, and then proceeds to play bingo in the usual manner simultaneously on each of the bingo faces. At the end of the game the bingo sheets are discarded after the winners have been determined and paid. Since a number of people may be playing bingo at the same time, it is highly desirable that each of the persons playing bingo have different sheets. Otherwise, more than one person would win at the same time using the identical bingo face. Accordingly, it is desirable to be able to print a large number of different bingo sheets, each having different bingo playing faces on them. In the past this problem has never been successfully solved.

According to John Scarne, *Scarne's Guide to Casino Gambling*, p. 313 (Simon and Schuster 1978), the number of bingo faces that could be printed is (24 numbers selected at random from 75 numbers):

111,007,923,832,370,565 but only about 9000 bingo faces are presently being used. These 9000 bingo faces represent a surface of 1000 square feet of printed paper. This is much larger than the surface area of a cylinder of a Webb press. Manufacturers of bingo sheets thus have to print the 9000 squares over 50 or more runs and then cut and assemble them like the pieces of a puzzle. Hence, today's manufacturers are in the position of the printer of a puzzle who has to separately print every piece of a puzzle, and then assemble them.

Moreover, the market is requesting larger and larger series. As bingo has become more popular, bingo games have included more than 1000 players, each one using 12 or 18 bingo faces simultaneously for 20 or 30 games. Five hundred thousand bingo faces can be used in one night by a single bingo operator. In some states, duplicate winners share the prize (winners resent it). In other states, the operator has to pay the full prize to every winner (the operator resents it). In both cases there is pressure on the manufacturers to increase the number of bingo faces without duplicates.

The use of a small (9000) series necessitates two precautions: (1) to print different color frames or outlines on each sheet to differentiate the sheets of one series from the sheets of the next series; up to 20 colors are used which necessitates an inventory of 20 times 50 runs; and (2) to print a serial number on every bingo face to identify bingo faces of the same series. Sheets from the same run are printed with different serial numbers. This makes assembling the pieces of the puzzle even more difficult.

Previously, large runs have been made of identical bingo sheets within each run. Large numbers of such runs have been made with the sheets from each run having different bingo faces. Then, collation has been carried out to provide sets of non-identical bingo sheets with each set having a large number of different sheets. To be able to provide such sets of different sheets, the printers have had to maintain truly huge inventories. The problem is further exacerbated by the requirement that the sets be available in several (generally twelve) different color combinations so that sheets from one game cannot become confused during play with sheets from previous games.

While printing is, of course, a quite old art and a number of wet printing machines are known, none will solve the above described problem. For example, some of this art is described in U.S. Pat. Nos. 1,973,034, issued Sept. 11, 1934 to H. V. Ball, 3,015,266, issued Jan. 2, 1962 to C. U. Anderson et al., 3,621,780, issued Nov. 23, 1971 to J. S. Tillotson, and 3,083,640, issued Apr. 2, 1963 to C. Milner. Such printing machinery as is shown in the four just-mentioned patents is designed primarily for producing multicolor printing on various media.

U.S. Pat. No. 3,083,640 discloses a particularly interesting apparatus for irregularly dyeing yarn. Parallel strands of yarn are fed through an apparatus having a series of printing rolls having different effective radii and circumferences. It is required that the circumference of the largest roll and the circumference of at least one of the other rolls in the series be in fractional relationship as opposed to whole number relationship. In this manner, an irregularly dyed series of strands of yarn are prepared. As will be apparent, such an apparatus is not useful for printing bingo sheets or other patterns having a series of separate images which must be specifically positioned.

DISCLOSURE OF THE INVENTION

The present invention is directed to overcoming one or more of the problems as set forth above.

In accordance with one embodiment of the present invention, a printing machine is provided which is adapted for printing a plurality of imprints onto a sheet divided into a plurality of sequentially longitudinally spaced printing fields having a selected field length. The apparatus comprises a plurality of spaced printing rolls having peripheral cylindrical surfaces having image transfer regions adapted to print the imprints onto the sheet, the rolls each having circumferences which are different integral multiples of the field length and which are not integral multiples of one another. Each of the cylindrical surfaces has a subset of the image transfer regions positioned to print the imprints on the printing fields. The printing fields have a null set intersection. Means are provided for rotating the rolls about their axes at a velocity such that the cylindrical surfaces have equal tangential velocities. Means are provided for transferring an image reproducing medium onto each of the image transfer regions. Means are provided for longitudinally moving the sheet generally tangentially sequentially adjacent each of the cylindrical surfaces at a velocity such that the sheet and the cylindrical surfaces have substantially zero relative velocity difference. In addition, means are provided for transferring the image reproducing medium from the image transfer regions to the printing fields as the sheet moves opposite the image transfer regions.

In accordance with another embodiment of the present invention, a method is set forth of printing a plurality of imprints onto a sheet divided into a plurality of sequentially longitudinally spaced printing fields having a selected field length. The method comprises feeding the sheet past a plurality of spaced printing rolls of the nature set forth above. The rolls are rotated about their axis at a velocity such that the cylindrical surfaces have equal tangential velocities. An image reproducing medium is transferred onto each of the image transfer regions. The image reproducing medium is transferred from the image transferring regions to the printing fields as the sheet moves opposite the image transfer regions.

When an apparatus and method in accordance with the present invention are utilized, one can readily print up literally millions of different bingo sheets without obtaining any repeated patterns. Alternatively, a number of printed scenes can be reproduced on wallpaper or the like with the colors of the scenes being varied and not repeating for a great number of cycles. The printed material which issues from an apparatus or process in accordance with the present invention has the changed bingo faces (or scenes) on it sequentially whereby there is no necessity to collate long runs of a series of identical bingo sheets or other printed material in order to obtain a stack having all different bingo sheets, or the like.

BRIEF DESCRIPTION OF DRAWINGS

The invention will be better understood by reference to the figures of the drawings wherein.

BEST MODE FOR CARRYING OUT THE INVENTION

Figures 1, 1A, 1B:
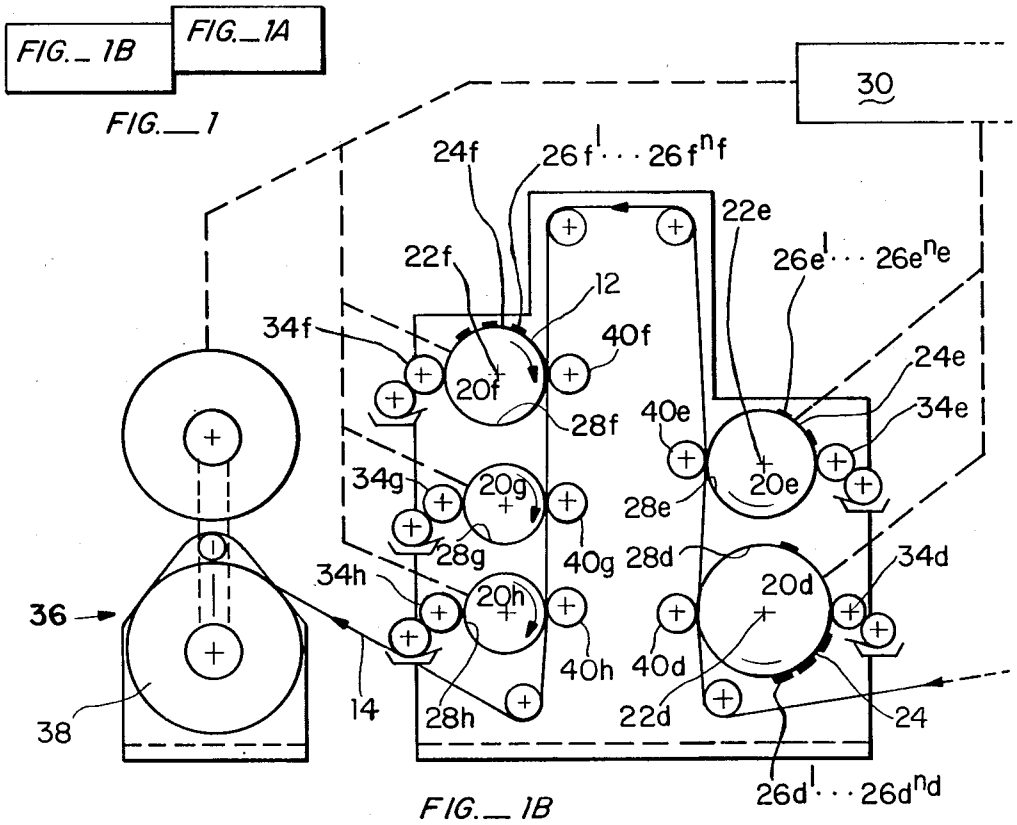
FIG. 1 (separated, because of size into FIGS. 1A and 1B as shown schematically in FIG. 1) illustrates, in side schematic view, an apparatus in accordance with the present invention.
Figure 1A:
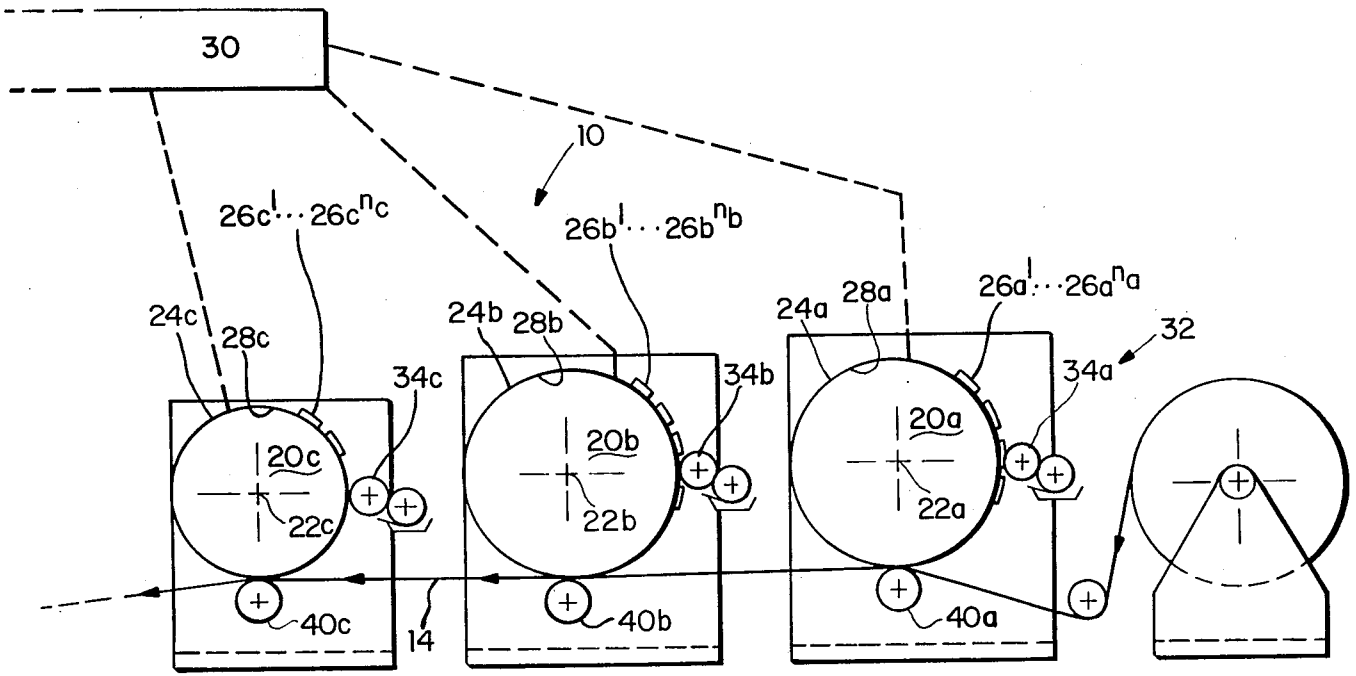
Figure 2:
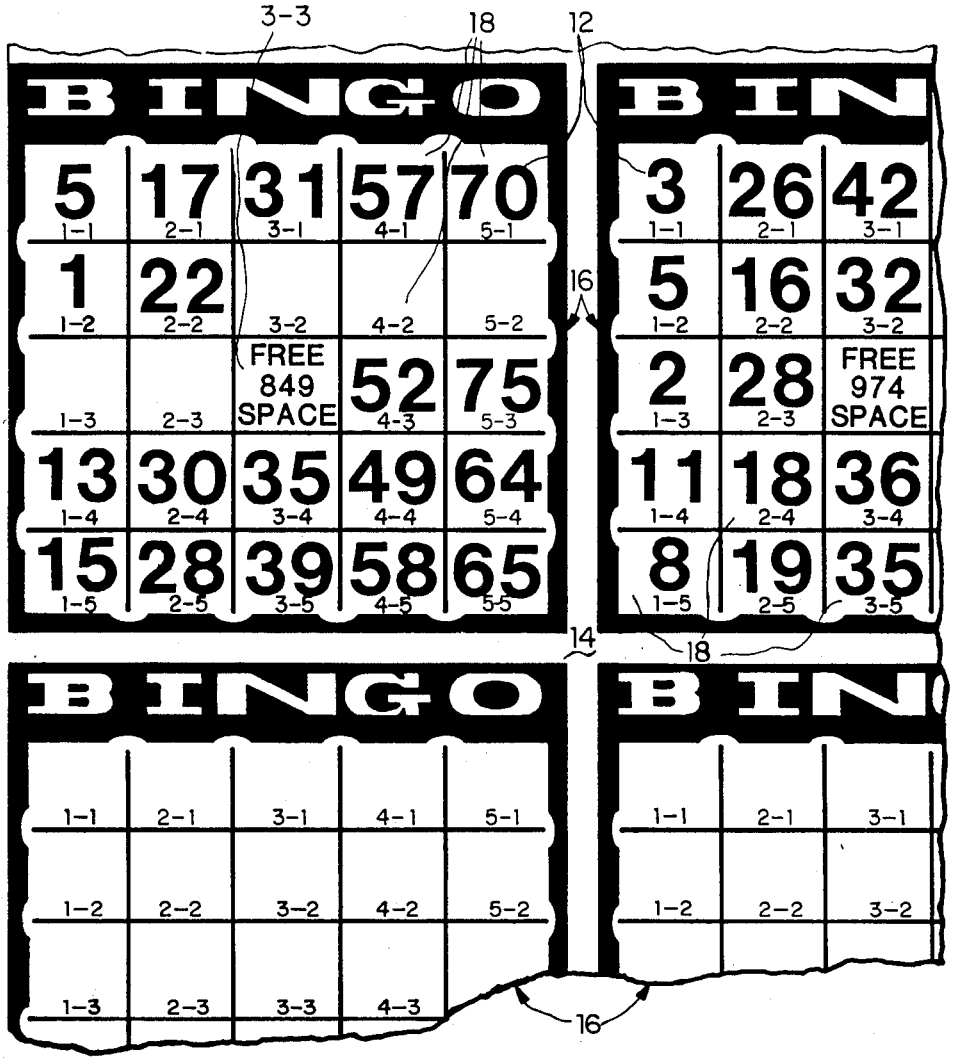
FIG. 2 illustrates a bingo sheet in accordance with an apparatus in accordance with the present invention.

Adverting to FIGS. 1 and 2, a printing machine 10 is illustrated which is adapted for printing a plurality of imprints 12 onto a sheet 14 which is divided into a plurality of sequentially longitudinally spaced printing fields 16 having a selected field length and generally being subdivided into a plurality of longitudinally and laterally spaced printing spaces or domains 18.

In accordance with the present invention, and as will be seen most clearly in FIGS. 1A–1B, a plurality of spaced printing rolls 20*a*–20*f* are provided having respective parallel axes 22*a*–22*f* and peripheral cylindrical surfaces 24*a*–24*f*. The rolls 20*a*–20*f* have image transfer regions $26a^1 \ldots 26a^{na}$–$26f^1 \ldots 26f^{nf}$ (e.g., fonts) which are adapted to print the imprints 12 (some omitted for clarity) onto the sheet 14. The image transfer regions $26a^1 \ldots 26a^{na}$–$26f^1 \ldots 26f^{nf}$ are positioned apart from one another along respective circumferences 28*a*–28*f* of the rolls 20*a*–20*f* a distance equal to the field length of the printing fields 16.

Furthermore, the circumferences 28*a*–28*f* are each different integral multiples of the field length of the printing fields 16 and are not integral multiples of one another. Thus, each of the cylindrical surfaces 28*a*–28*f* have a subset of the image transfer regions $26a^1$–$26f^{nf}$ positioned to print the imprints 12 on only a selected subset of the printing domains 18. Furthermore, in accordance with one preferred embodiment of the present invention, the selected subsets of the printing domains 18 have a null set intersection. That is, each subset of image transfer regions $26a^1$–$26f^{nf}$ prints on a unique subset of printing domains 18.

The above concept may be more easily understood by reference to a specific example, namely the example wherein a bingo sheet as illustrated in FIG. 2 is printed utilizing such an apparatus. For simplicity we shall consider the printing roll 20*f*. The field length, by reference to FIG. 2, is the length of one bingo face plus assorted writings, e.g., the word "BINGO". Let us assume that the roll 20*f* is precisely twelve field lengths in circumference. Let us assume further that the roll 20*f* prints numbers onto four selected squares or domains 18 on each bingo face on the sheet 12 (one-sixth of the 24 squares other than the "free" square). For the sake of simplicity, we will assume that the four domains on which the roll 20*f* prints are the domains designated 1-1, 1-2, 1-3 and 1-4 in FIG. 2.

The image transfer regions (of the set $26f^1$–$26f^{nf}$) on roll 20*f* which are positioned to print in the domain 1-1 print in that domain on each of the longitudinally sequential bingo faces (printing fields) 16 on the sheet 14. It should be noted that the numbers present in the first column (1-1, 1-2, 1-3, 1-4 and 1-5) on the printing field 16 are the numbers 1–15 in accordance with the rules of bingo. Accordingly, each of the five domains 1-1 through 1-5 may be restricted to having three numbers (one-fifth of the numbers 1–15) printed thereon while each of the other domains 1-1 through 1-5 may not have any of the numbers printed thereon which are printed in any of the other such domains. For example, the domain 1-1 may be limited to having printed thereon the numbers 1, 2 and 3. Next, the domain 1-2 may be limited to having printed thereon the numbers 4, 5 and 6, etc. The image transfer regions on roll 20*f* which print on the domain 1-1 will then have the numerals 1, 2 and 3 randomly arranged thereon and of substantially equal probability of being printed. For example, the sequence could be 1-3-2-3-1-2-1-2-3-2-3-1. This would provide a sequence of numbers in the domain 1-1 which would be repeated after every twelve longitudinally sequential bingo faces were printed. Generally, although the numbers being printed by the roll 20*f* have been discussed as being all in the column 1, such numbers would be scattered about the cards so as to make detection of such a sequence more difficult. Also, generally each corner printing domain 18 would be printed by a different one of the rolls 20*a*–20*f*. This would be done to allow playing of a variation of bingo wherein drawing the numbers in all four corner domains 18 leads to a win.

At the same time, the roll 20*e* might have a circumference thirteen times the field length of the printing field 16. In this manner, those domains 18 which are printed upon by the roll 20*e* would start repeating after thirteen longitudinally spaced printing fields 16 had been printed upon. Because of the offset between the repetition after twelve longitudinally spaced printing fields 16 are printed upon by roll 20*f* and thirteen longitudinally spaced printing fields 16 are printed upon by roll 20*e*, one would obtain twelve times thirteen combinations.

Sequentially, the roll 20*d* might have a circumference of seventeen printing fields 16, the roll 20*c* might have a circumference of nineteen printing fields 16, the roll 20*b* might have a circumference of twenty-three printing fields 16 and the roll 20*a* might have a circumference of twenty-nine printing fields 16. As will be noted, the product of twelve times thirteen times seventeen times nineteen times twenty-three times twenty-nine leads to over two hundred million printings before a repetition occurs.

The additional printing rolls 20*g* and 20*h* can be utilized to print repetitive subject matter such as the grid of the card, the background color upon which the word "bingo" appears, or the like. Such might be in different colors than is the printing of the numbers upon the spaces on the bingo playing faces 16.

Means 30, comprising essentially control circuitry of a conventional nature, is used for rotating the rolls 20*a*–20*f* about their axes 22*a*–22*f* at a velocity such that the cylindrical surfaces 24*a*–24*f* have equal tangential velocities. This is to assure smear-free printing. Means 32 is provided for transferring an image reproducing medium onto each of the image transfer regions 26*a*$^{1}$–26*f*$^{nf}$. In the embodiment illustrated, the image reproducing medium transfering means 32 simply comprises a plurality of conventional inking rolls 34*a*–34*f*.

Means 36 is provided for longitudinally moving the sheet 14 generally tangentially sequentially adjacent each of the cylindrical surfaces 24*a*–24*f* at a velocity such that the sheet 14 and the cylindrical surfaces 24*a*–24*f* have zero relative velocity difference. The longitudinal moving means 36, in the embodiment illustrated, simply conprises a takeup reel 38 conventionally motor-powered to motivate the sheet 14 from right to left in FIG. 1. Other longitudinal moving means 36 can be utilized and, for example, it may be preferable to cut the sheet 14 as it exits the roll 20*h* into the desired sheet length.

Also in accordance with the present invention, means 40*a*–40*f* is provided for transferring the image reproducing medium from the image transfer regions 26*a*$^{1}$–26*f*$^{nf}$ to the printing domains 18 as the sheet 14 moves opposite the aforesaid image transfer regions 26*a*$^{1}$–26*f*$^{nf}$. The transferring means 40*a*–40*f*, in the embodiment illustrated, merely comprises a plurality of rollers 40*a*–40*f* which cause the sheet 14 to contact the image transfer regions 26*a*$^{1}$–26*f*$^{nf}$ whereby ink is transferred to the sheet 14.

It may also be desirable to provide means for drying the sheet 14 following transferring of the image reproducing medium to the printing domains 18. Such drying means is not illustrated because of its conventional nature, but might consist of air drying chambers through which the sheet 14 is passed intermediate some of the rollers 28*a*–28*f* or after exit from the last of the rollers 20*h*.

As may be seen in FIG. 2, each of the printing fields 16 may comprise a five by five orthogonal array of spaces 18 which comprise the printing domains and which define the bingo face 16. A central one 3-3 of the spaces 18 is normally designated a "free" space in such a situation. As explained above, in such a situation, each of the subsets of image transfer regions 26*a*$^{1}$–26*f*$^{nf}$ is positioned to print the imprints 12 on only a selected subset of the spaces 18 and the imprints 12 then comprise only a selected set of numbers. As is seen in FIG. 2, the selected set of numbers would include the numbers from 1–75 positioned as normally on a bingo card with the numbers 1–15 in the leftwardmost column, numbers 16–30 in the next rightward column, numbers 31–45 in the next rightward column, numbers 46–60 in the next rightward column, and the numbers 61–75 in the rightwardmost column. In such a situation there are twenty-four domains 18 on each playing field 16.

In accordance with a preferred embodiment of the invention, each of the six rolls 20*a*–20*f* will print the imprints 12 in three to five of the spaces 18 with the number of image transfer regions 26*a*$^{1}$–26*f*$^{nf}$ being positioned to print the imprints 12 in each of the three to five spaces 18 being equal to the circumference of the rolls 20*a*–20*f* bearing such image transfer regions 26*a*$^{1}$–26*f*$^{nf}$ divided by the field length and with the image transfer regions 26*a*$^{1}$–26*f*$^{nf}$ being positioned to print the imprints 12 in each one of the three to five spaces being positioned apart from one another along the respective one of the circumferences 28*a*–28*f* a distance equal to the field length.

Again referring to FIG. 2, it will be seen that the sheet 14 will generally have a plurality of sequentially laterally spaced printing fields 16. This will provide bingo playing sheets 14 having several bingo faces 16 on them as is now conventional. For example, the plurality of laterally spaced playing fields 16 may be four or six or eight and the sheet 16 may be appropriately cut to provide sheets having, for example, two laterally across playing fields 16 by four longitudinal across playing fields 16.

Figure 3:
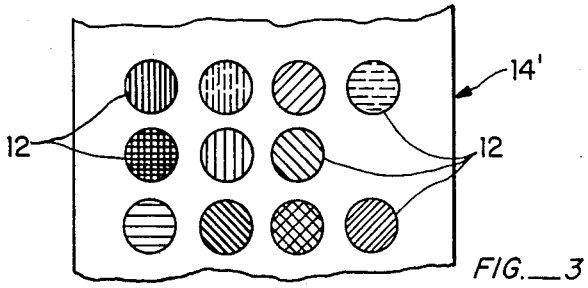
FIG. 3 illustrates a portion of a piece of a paper such as wallpaper printed in accordance with an alternate embodiment of the present invention.

FIG. 3 illustrates the result of utilizing an embodiment of the present invention wherein the image reproducing medium is selected to be of a different color for each of the rolls 20*a*–20*f*. In this situation each of the image transfer regions 26*a*$^{1}$–26*f*$^{nf}$ may print like sized and shaped imprints 12' (shown in FIG. 3 as circles) as does each other of said image transfer regions 26*a*$^{1}$–26*f*$^{nf}$ with the imprints 12 varying from one another in the number of minute dots of image reproducing material producing a given imprint, such number of dots being determined by the construction of a corresponding one of the image transfer regions 26*a*$^{1}$–26*f*$^{nf}$ producing the given imprint. Image transfer regions 26*a*$^{1}$–26*f*$^{nf}$ from different of the rolls 20*a*–20*f* can print on the same imprint thus providing intermediate mixed colors. Combinations of the above techniques may also be utilized to produce different effects; for example, color and image may both be changed.

Also in accordance with the present invention a method is set forth of printing a plurality of imprints 12 onto a sheet 14 divided into a plurality of sequentially longitudinally spaced printing fields 16 having a selected field length. The method comprises feeding the sheet 14 past the plurality of rolls 20*a*–20*f* as previously discussed while rotating the rolls, also as previously discussed, transferring an image reproducing medium onto image transfer regions 26*a*$^{1}$–26*f*$^{nf}$ and transferring the image reproducing medium from the image transfer regions 26*a*$^{1}$–26*f*$^{nf}$ to the printing fields 16 as they pass opposite the respective image transfer regions 26*a*$^{1}$–26*f*$^{nf}$.

Industrial Applicability

The apparatus 10 and method of the present invention are particularly useful for printing bingo sheets 14 and/or wallpaper 14'. Literally millions of non-reproducing ordered patterns can be produced when operating in accordance with the present invention.

While the invention has been described in connection with certain specific embodiments thereof, it is understood that such description was for convenience only and that other advantages and objects of the invention will become apparent to one skilled in the art from the foregoing description and the accompanying drawings and that the invention includes such advantages and objects.

I claim:

1. A printing apparatus (10) adapted for printing a plurality of imprints (12) onto a sheet (14) divided into a plurality of sequentially longitudinally spaced printing fields (16) having a selected field length, said printing fields (16) each being divided into a plurality of longitudinally and laterally spaced printing domains (18), comprising:

a plurality of spaced printing rolls (20*a*–20*f*) having peripheral cylindrical surfaces (24*a*–24*f*), each of said rolls (20*a*–20*f*) having image transfer regions ($26a^1$–$26f^{n,f}$) adapted to print said imprints (12) onto each of said printing fields (16) on said sheet (14), said rolls (20*a*–20*f*) each having circumferences (28*a*–28*f*) which are different integral multiples of said field length and which are not integral multiples of one another, each of said cylindrical surfaces (28*a*–28*f*) having a subset of said image transfer regions ($26a^1$–$26f^{n,f}$) positioned to print said imprints (12) on said printing fields (16), each of said subsets of said image transfer regions ($26a^1$–$26f^{n,f}$) on each of said rolls (20*a*–20*f*) being positioned to print said imprints (12) on only a selected subset of said longitudinally and laterally spaced printing domains (18), said printing fields (16) having a null set intersection with one another and said selected subsets of said printing domains (18) having a null set intersection with one another;

means (30) for rotating said rolls (20*a*–20*f*) about said axes (22*a*–22*f*) at a velocity such that said cylindrical surfaces (24*a*–24*f*) have equal tangential velocities;

means (32) for transferring an image reproducing medium onto each of said image transfer regions ($26a^1$–$26f^{n,f}$);

means (36) for longitudinally moving said sheet (14) generally tangentially sequentially adjacent each of said cylindrical surfaces (24*a*–24*f*) at a velocity such that said sheet (14) and said cylindrical surfaces (24*a*–24*f*) have zero relative velocity difference; and means (40*a*–40*f*) for transferring said image reproducing medium from said image transfer regions ($26a^1$–$26f^{n,f}$) to said printing domains (18) on each of said printing fields (16) as said sheet (14) moves opposite said image transfer regions ($26a^1$–$26f^{n,f}$).

2. A printing apparatus (10) as set forth in claim 1, wherein each one of said subsets of said image transfer regions ($26a^1$–$26f^{n,f}$) prints different imprints (12) than does each other of said subsets of said image transfer regions ($26a^1$–$26f^{n,f}$).

3. A printing apparatus (10) as set forth in claim 2, wherein each of said printing fields (16) comprises a five by five orthogonal array of said printing domains (18) and which define a bingo face (16), a central one of said domains (18) being designated a free space, wherein each of said subsets of image transfer regions ($26a^1$–$26f^{n,f}$) is positioned to print said imprints (12) on only a selected subset of said domains (18) and wherein said imprints (12) comprise a selected set of numbers.

4. A printing apparatus (10) as set forth in claim 3, wherein said selected set of numbers includes the numbers from 1 through 75, wherein said plurality of rolls (20*a*–20*f*) comprises six rolls (20*a*–20*f*) and wherein each of said subsets of said image transfer regions ($26a^1$–$26f^{n,f}$) is adapted to print said imprints (12) in three to five of said domains (18), the number of image transfer regions ($26a^1$–$26f^{n,f}$) positioned to print said imprints (12) in each of said three to five domains (18) being equal to the respective circumference (28*a*–28*f*) of the respective roll (20*a*–20*f*) bearing such image transfer regions ($26a^1$–$26f^{n,f}$) divided by said field length, said image transfer regions ($26a^1$–$26f^{n,f}$) positioned to print said imprints (12) in each of said three to five domains (18) being positioned apart from one another along a respective one of said circumferences (28*a*–28*f*) a distance equal to said field length.

5. A printing apparatus (10) as set forth in claim 4, wherein each of said subsets of said image transfer regions ($26a^1$–$26f^{n,f}$) prints a subset of said numbers from 1 to 75, each subset of said image transfer regions ($26a^1$–$26f^{n,f}$) being adapted to print a corresponding subset of said numbers with each one of said numbers of each of said subsets of said numbers being printed substantially equally often.

6. A printing apparatus (10) as set forth in claim 3, wherein said sheet (14) further has a plurality of sequentially laterally spaced printing fields (16), wherein said selected set of numbers includes the numbers from 1 through 75, wherein said plurality of rolls (20*a*–20*f*) comprises six rolls (20*a*–20*f*) and wherein each of said subsets of said image transfer regions ($26a^1$–$26f^{n,f}$) is adapted to print said imprints (12) in three to five of said domains (18) on each of said laterally spaced printing fields (16), the number of image transfer regions ($26a^1$–$26f^{n,f}$) positioned to print said imprints (12) in each of said three to five domains (18) on each of said laterally spaced printing fields (16) being equal to the respective circumference (28*a*–28*f*) of the respective roll (20*a*–20*f*) bearing such image transfer regions ($26a^1$–$26f^{n,f}$) divided by said field length, said image transfer regions ($26a^1$–$26f^{n,f}$) positioned to print said imprints (12) in each one of said three to five domains (18) on each of said laterally spaced printing fields (16) being positioned apart from one another along said respective circumference (28*a*–28*f*) a distance equal to said field length.

7. A printing apparatus (10) as set forth in claim 6, wherein each of said subsets of said image transfer regions ($26a^1$–$26f^{n,f}$) prints a subset of said numbers from 1 through 75 on each of said three to five domains (18) on each of said laterally spaced printing fields (16), each subset of said image transfer regions ($26a^1$–$26f^{n,f}$) being adapted to print a corresponding subset of said numbers with each one of said numbers of each of said subsets of said numbers being printed substantially equally often.

8. A printing apparatus (10) adapted for printing a plurality of imprints (12) onto a sheet (14) divided into a plurality of sequentially longitudinally spaced printing fields (16) having a selected field length, said printing fields (16) each being divided into a plurality of longitudinally and laterally spaced printing domains (18), comprising:

a plurality of spaced printing rolls (20*a*–20*f*) having peripheral cylindrical surfaces (24*a*–24*f*) having image transfer regions ($26a^1$–$26f^{n,f}$) adapted to print said imprints (12) onto said sheet (14), said rolls (20*a*–20*f*) each having circumferences (28*a*–28*f*) which are different integral multiples of said field length and which are not integral multiples of one another, each of said cylindrical surfaces (28*a*–28*f*) having a subset of said image transfer regions ($26a^1$–$26f^{n,f}$) positioned to print said imprints (12) on said printing fields (16), said printing fields (16) having a null set intersection;

means (30) for rotating said rolls (20–20*f*) about said axes (22*a*–22*f*) at a velocity such that said cylindrical surfaces (24*a*–24*f*) have equal tangential velocities;

means (32) for transferring an image reproducing medium onto each of said image transfer regions ($26a^1$–$26f^{nf}$);

means (36) for longitudinally moving said sheet (14) generally tangentially sequentially adjacent each of said cylindrical surfaces (24*a*–24*f*) at a velocity such that said sheet (14) and said cylindrical surfaces (24*a*–24*f*) have zero relative velocity difference; and means (40*a*–40*f*) for transferring said image reproducing medium from said image transfer regions ($26a^1$–$26f^{nf}$) to said longitudinally and laterally spaced printing domains (18) as said sheet (14) moves opposite said image transfer regions ($26a^1$–$26f^{nf}$), said image reproducing medium being selected to be of a different color for each of said rolls (20*a*–20*f*), each of said image transfer regions ($26a^1$–$26f^{nf}$), printing like sized and shaped imprints (12) as does each other of said subsets of said image transfer regions ($26a^1$–$26f^{nf}$) with said image transfer regions ($26a^1$–$26f^{nf}$) on each of said rolls (20*a*–20*f*) producing imprints (12) having selected densities of minute dots of each of said colors, image transfer regions ($26a^1$–$26f^{nf}$) on different of said rolls (20*a*–20*f*) printing overlapping upon one or more of said imprints (12) to produce mixtures of said colors.

9. A printing apparatus (10) as set forth in claim 8, wherein said image transfer regions ($26a^1$–$26f^{nf}$) are equally spaced circumferentially on said cylindrical surfaces (24*a*–24*f*), the circumferential separation of adjacent of said image transfer regions ($26a^1$–$26f^{nf}$) being equal to said field length.

10. A method of printing a plurality of imprints (12) onto a sheet (14) divided into a plurality of sequentially longitudinally spaced printing fields (16) having a selected field length, said printing fields (16) each being divided into a plurality of longitudinally and laterally spaced printing domains (18), comprising:

feeding said sheet (14) past a plurality of spaced printing rolls (20*a*–20*f*) having peripheral cylindrical surfaces (24*a*–24*f*), each of said rolls (20*a*–20*f*) having image transfer regions ($26a^1$–$26f^{nf}$) adapted to print said imprints (12) onto each of said printing fields (16) on said sheet (14), said rolls (20–20*f*) each having circumferences (28*a*–28*f*) which are different integral multiples of said field length and which are not integral multiples of one another, each of said cylindrical surfaces (28*a*–28*f*) having a subset of said image transfer regions ($26a^1$–$26f^{nf}$) positioned to print said imprints (12) on said printing fields (16) each of said subsets of said image transfer regions ($26a^1$–$26f^{nf}$) on each of said rolls (20*a*–20*f*) being positioned to print said imprints (12) on only a selected subset of said longitudinally and laterally spaced printing domains (18), said printing fields (16) having a null set intersection with one another and said selected subsets of said printing domains (18) having a null set intersection with one another;

rotating said rolls (20*a*–20*f*) about said axes (22*a*–22*f*) at a velocity such that said cylindrical surfaces (24*a*–24*f*) have equal tangential velocities;

transferring an image reproducing medium onto each of said image transfer regions ($26a^1$–$26f^{nf}$); and transferring said image reproducing medium from said image transfer regions ($26a^1$–$26f^{nf}$) to said printing fields (16) as said printing fields (16) pass opposite said image transfer regions ($26a^1$–$26f^{nf}$).

11. A method as set forth in claim 10, wherein each one of said subsets of said image transfer regions ($26a^1$–$26f^{nf}$) prints different imprints (12) than does each other of said subset of said image transfer regions ($26a^1$–$26f^{nf}$).

12. A method as set forth in claim 11, wherein each of said printing fields (16) comprises a five by five orthogonal array of said domains (18) and which define a bingo face (16), a central one of said domains (18) being designated a free space, wherein each of said subsets of image transfer regions ($26a^1$–$26f^{nf}$) is positioned to print said imprints (12) on only a selected subset of said domains (18), and wherein said imprints (12) correspond to a selected set of numbers including the numbers from 1 through 75.

* * * * *